United States Patent [19]

Sakuma et al.

[11] Patent Number: 4,661,666

[45] Date of Patent: Apr. 28, 1987

[54] VACUUM INTERRUPTER

[75] Inventors: Shinzo Sakuma, Kawasaki; Nobuaki Tamaki, Zushi; Hideo Kawakami, Kawasaki, all of Japan

[73] Assignee: Kabushiki Kaisha Meidensha, Tokyo, Japan

[21] Appl. No.: 865,895

[22] Filed: May 21, 1986

[30] Foreign Application Priority Data

May 28, 1985 [JP] Japan ..... 60-115137
Jun. 20, 1985 [JP] Japan ..... 60-134814

[51] Int. Cl.[4] ..... H01H 33/66
[52] U.S. Cl. ..... 200/144 B
[58] Field of Search ..... 200/144 B

[56] References Cited

U.S. PATENT DOCUMENTS 3,946,179 3/1976 Murano et al. ..... 200/144 B
4,109,123 8/1978 Lipperts ..... 200/144 B
4,115,672 9/1978 Lipperts ..... 200/144 B

FOREIGN PATENT DOCUMENTS 0101024 of 1983 European Pat. Off. ..... 200/144 B
2707148 of 1977 Fed. Rep. of Germany ... 200/144 B
2911706 10/1980 Fed. Rep. of Germany ... 200/144 B
1916401 of 1969 German Democratic Rep. ..... 200/144 B
2009895 of 1970 German Democratic Rep. ..... 200/144 B
135661 5/1979 German Democratic Rep. ..... 200/144 B
230108 11/1985 German Democratic Rep. ..... 200/144 B
1529669 of 1977 United Kingdom ..... 200/144 B

*Primary Examiner*—Robert S. Macon
*Attorney, Agent, or Firm*—Bachman & LaPointe

[57] ABSTRACT

An inventive vacuum interrupter exhibits a high interruption performance. The interrupter includes a metal end plate constituting part of its vacuum envelope, and a coil disposed outside the vacuum envelope and near the metal end plate and generating an axial magnetic field parallel to a path of an arc in an arcing gap between a pair of separable contact within the vacuum envelope. The contact near the coil is made of a material superior in interruption performance to the end plate and is mounted with a clearance onto the end plate. The clearance is at least 2 mm and at most 30% of the diameter of the coil-side contact.

16 Claims, 12 Drawing Figures

VACUUM INTERRUPTER

BACKGROUND OF THE INVENTION

This invention generally relates to vacuum interrupters such as are used in electrical power transmission and distribution devices. It more particularly relates to vacuum interrupters with a coil applying an axial magnetic field parallel to an arc current path established between contacts separated during current interruption.

Common vacuum interrupters include the type in which a coil applies an axial magnetic field parallel to an arc current path established between contacts separated during current interruption. The axial magnetic field improves the interruption performance of the vacuum interrupters (i.e., current interruption capability and dielectric strength).

Axial-magnetic-field-type vacuum interrupters are classified into two types. In one type (refer to U.S. Pat. No. 4,115,672 or UK-A-1,529,669), the coil surrounds the outside of a cylindrical envelope of the vacuum interrupter. In the other type (refer to U.S. Pat. No. 3,946,179 or UK-A-1,478,702), the field-generating coil lies behind one contact within a vacuum envelope of the interrupter. The former vacuum interrupter has the advantage of better heat dissipation from the coil and on the other hand, has the disadvantage of a greater outer diameter since its coil surrounds the outside of the cylindrical envelope of the vacuum interrupter. The latter vacuum interrupter is advantageously compact since it has a compact axial-magnetic-field-generating coil within the vacuum envelope. On the other hand, the latter vacuum interrupter has the disadvantage of reduced heat dissipation from the coil since the coil is located within the vacuum envelope. The latter vacuum interrupter also has a disadvantage with regard to durability since the impact of the contacts upon closing the circuit acts on the coil.

Thus, a recent development has been an axial-magnetic-field-type vacuum interrupter having the coil behind one contact and outside of the envelope of the vacuum interrupter, i.e., opposing the outer surface of a circular metal end plate constituting part of the vacuum envelope.

FIG. 1 illustrates this prior vacuum interrupter. The major part of a vacuum envelope 1 comprises an electrically insulating cylinder 2 made of alumina ceramics, a metal cylinder 3 made of Fe-Ni-Co alloy (e.g., Koval) and coaxially hermetically sealed to the insulating cylinder 2, and metal end plates 4 and 5, the stationary-side end plate 4 made of austenitic stainless steel (e.g., SUS 304L) and hermetically sealed to the outer edge of the metal cylinder 3 and the movable-side end plate 5 made of Fe-Ni-Co alloy (e.g., Koval) and hermetically sealed to the outer edge of the insulating cylinder 2. A stationary lead rod 6 extends through the end plate 4 and a movable lead rod 7 extends through the end plate 5. The movable lead rod 7 can move toward and away from the stationary lead rod 6. The inner end of the stationary lead rod 6 has a disc-shaped stationary contact 8 in contact with the inner surface of the end plate 4. The inner end of the movable lead rod 7 has a disc-shaped movable contact 9 opposing the contact 8. The contacts 8 and 9 are made of a composite material including components of Cu, Mo, and Cr, e.g. Cu-25Mo-7Cr represented in terms of weight % and powder-metallurgically produced (referred to as a Cu-25Mo-7Cr composite material). EP-A-0101024 discloses that a powder-metallurgically produced composite material, e.g. Cu-Mo-Cr, will enhance the interruption performance of a vacuum interrupter.

An axial magnetic field generating coil 10 is disposed close to and behind the contact 8 and outside of the vacuum envelope 1. One end of the coil 10 is electrically connected to the stationary lead rod 6 and the other end of the coil 10 is electrically connected to a terminal 11 of a related power circuit. A flange of the cylindrical shield 12 made of SUS 304L is mounted on the inner surface of the metal cylinder 3 coaxially with the insulating cylinder 2. The shield 12 is equipotential to the stationary contact 8. A bellows 13 sealingly connects the movable lead rod 7 to the end plate 5. A bellows shield 14 is mounted on the movable lead rod 7 in front of the inner end of the bellows 13.

The vacuum interrupter of FIG. 1 exhibits advantages in heat dissipation, durability and compactness.

However, the vacuum interrupter of FIG. 1 exhibited interruption performance lower than that of a vacuum interrupter similar to the example of FIG. 1 but having a pair of contacts made of a Cu-0.5Bi alloy. The vacuum interrupter of FIG. 1 was disassembled and inspected in detail. The present inventors discovered traces of erosion where electrical arcing occurred between the movable contact 9 and an inner surface area of the stationary-side end plate 4 mounted on the stationary contact 8. The present inventors concluded from the above inspection that a suitable combination of materials for the stationary contact 8 and the stationary-side end plate 4, and a clearance between the stationary contact 8 and the stationary-side end plate 4 of the vacuum envelope would relieve the arcing erosion and so have a good effect on the interruption performance of the vacuum interrupter shown in FIG. 1.

The above-described combination of materials and the above-described clearance constitute a primary aspect of a problem to be solved in the vacuum interrupter of FIG. 1. However, a polarity effect in the interruption performance of the vacuum interrupter of FIG. 1 constitutes a subordinate aspect of this problem, described right after this.

In the vacuum interrupter of FIG. 1, magnetic lines of force F generated by the coil 10 tend to deflect from the inside portion of the movable contact 9 to the outside portion of the movable contact 9 due to the large distance between the movable contact 9 and the coil 10, so that a polarity effect occurs in the interruption performance of the vacuum interrupter. Specifically, when the potential of the stationary contact 8 is negative this polarity effect reduces interruption performance of the vacuum interrupter to a lower level than when the potential of the stationary contact 8 is positive during alternating current interruption. In detail, when charged particles are emitted from the movable contact 9, they are effectively directed to the stationary contact 8 along the magnetic lines of force F. On the other hand, when charged particles are emitted from the stationary contact 8, some of the charged particles in the inner area near the periphery of the stationary contact 8 will not reach the movable contact 8 but will spread out into the vacuum envelope 1 along the magnetic lines of force F.

In view of this polarity effect, the diameter of the movable contact 39 (refer to FIG. 8) was selected to be greater than that of the stationary contact 8. Tests were carried out on the interruption performance of a vacuum interrupter with this enlarged movable contact 39, but otherwise similar to the example of FIG. 1. In the vacuum interrupter of FIG. 1 in which the diameters of the stationary and movable contacts 8 and 9 are equal, when a positive potential current is applied to the stationary contact 8, the interruption performance is assigned to value 100%, then when a negative potential current is applied to the stationary contact 8, the interruption performance of the same vacuum interrupter is 80%.

On the other hand, corresponding interruption performances of a vacuum interrupter which is similar to the example of FIG. 1 but in which the diameter of the movable contact 39 is 10% greater than that of the stationary contact 8 are 110% and 90%. These results show that the enlarged diameter of the movable contact 39 corrects for the polarity effect on interruption performance since charged particles emitted from the stationary contact 8 are able to reach the movable contact 39 in spite of the curvature of the magnetic lines of force F.

However, new problems were caused when the diameter of the movable contact 39 was enlarged. Specifically, the electric field strength at the periphery of the movable contact 39 markedly increases since the gap between the periphery of the movable contact 39 and the shield 12 equipotential to the stationary contact 8 decreases as the diameter of the movable contact 39 increases. Therefore, the dielectric strength of the vacuum interrupter is reduced and the gap between the periphery of the movable contact 39 and the shield cannot withstand the transient recovery voltage right after current interruption. This problem is quite serious in the case of the interrupter shown in FIG. 1, since the shield 12 surrounding the movable contact 39 is equipotential to the stationary contact 8, and the potential difference between the shield 12 and the contact 9 increases more than in the case of the vacuum interrupter of FIG. 2 in which the shield 23 surrounding disc-shaped stationary and movable contacts 21 and 22 is at an intermediate potential.

In order to resolve this problem, the present inventors invented a vacuum interrupter as shown in FIG. 8 similar to the example of FIG. 1. As shown in FIG. 8, the diameter of the movable contact 39 is 10% greater than the diameter of the stationary contact 8. The movable contact 39 has no axial magnetic field generating coil; rather, the axial magnetic field generating coil 10 is behind the stationary contact 8. An essentially conical moderating shield 40 made of austenitic stainless steel (e.g., SUS 304L) is mounted on and surrounds the movable lead rod 7 right behind the movable contact 39, i.e. on the side of the movable contact 39 remote from the arcing gap between the stationary and movable contacts 8 and 39, in order to moderate the concentration of the electric field near the periphery of the movable contact 39.

Equipotential lines E shown in broken lines illustrate that the shield 40 moderates the concentration of the electric field between the vapor shield 12 and the movable contact 39.

The enlarged base of the moderating shield 40 has an annular curl 40*a* which curls into the interior of the moderating shield 40. The annular curl 40*a* of the moderating shield opposes the periphery of the back surface of the movable contact 39. The maximal outer diameter of the annular curl 40*a* is approximately equal to the diameter of the movable contact 39. When the maximal outer diameter of the annular curl 40*a* is greater than the diameter of the movable contact 39, the foot of the electrical arc generated in the arcing gap between the stationary and movable contacts 8 and 39 is at the annular curl 40*a* rather than at the movable contact 39, thus reducing the interruption performance of the vacuum interrupter. On the other hand, when the maximal outer diameter of the annular curl 40*a* is smaller than the diameter of the movable contact 39, the moderating shield 40 has no effect and the electric field strength in the outer area near the periphery of the movable contact 39 is excessive, thus reducing the interruption performance of the vacuum interrupter. The rounded apex 40*c* of the moderating shield 40 has an aperture 40*b* through which the movable lead rod 7 passes. Thus, the moderating shield 40 exhibits a moderately curved outer surface extending from the annular curl 40*a* to the rounded apex 40*c*.

However, the vacuum interrupter of FIG. 8 failed to exhibit the expected improvement in interruption performance. The vacuum interrupter of FIG. 8 was then disassembled and inspected in detail. The present inventors discovered traces of erosion due to electric arcing between the movable contact 39 and an inner surface area of the end plate 4 surrounding the stationary contact 8. It was concluded that the enlargement of the diameter of the movable contact 39 could not prevent the foot of the electrical arc from transferring from the stationary contact 8 to the end plate 4 so that ionized vapor emitted from the movable contact 39 will not always reach the stationary contact 8 along the magnetic lines of force F of the coil 10. The present inventors concluded from the above inspection that the suitable combination of materials for the stationary contact 8 and the stationary-side end plate 4 as well as a clearance between a stationary contact and the stationary-side metal end plate of the vacuum envelope would enhance interruption performance of a vacuum interrupter such as is shown in FIG. 8.

SUMMARY OF THE INVENTION

An object of this invention is to provide a vacuum interrupter of a high interruption performance with a coil generating an axial magnetic field aligned parallel to the path of arcs generated in an arcing gap between contacts of the vacuum interrupter. In order to achieve of this object, an inventive vacuum interrupter comprising a vacuum envelope including an electrically insulating cylinder; a pair of metallic stationary- and movable-side end plates constituting part of the vacuum envelope and hermetically sealed to opposite open ends of the insulating cylinder, one of the end plates being a coil-side end plate; a pair of relatively movable disc-shaped contacts supported within the vacuum envelope, a movable contact being movable by a bellows from a closed position in conductive engagement with a stationary contact, and at an open position the movable contact separated from the stationary contact with an arcing gap therebetween across which an arc forms during circuit interruption, one of the contacts being a coil-side contact; a pair of electrical lead members each supporting and electrically connected to a corresponding contact; and a coil disposed outside the vacuum envelope and near the coil-side end plate for generating an axial magnetic field parallel to the path of the arc in the arcing gap, characterized in that said coil-side contact is made of a material superior in interruption performance to said coil-side end plate and that the coil-side contact is mounted with a clearance to the coil-side end plate, the clearance being at least 2 mm and at most 30% of the diameter of the coil-side contact.

According to this invention, an arc generated in an arcing gap between the contacts during circuit interruption does not transfer from the coil-side contact to the coil-side end plate and thus does not reduce the effect of the axial magnetic field of the coil, which leads to an improvement in the interruption performance of the vacuum interrupter.

According to one aspect of this invention, the coil-side contact is made of a material superior in interruption performance to the coil-side end plate.

According to another aspect of this invention, the interrupter includes a coil for generating an axial magnetic field parallel to the path of the arc in the arcing gap, said coil being disposed outside the vacuum envelope and closer to coil-side contact. The diameter of the other contact is greater than that of the coil-side contact in order to prevent the aforementioned polarity effect. A vapor shield of a potential different from that of the other contact is provided within the insulating cylinder. A shield is provided in order to degrade the concentration of the electric field at the outer portion of the other contact in a gap between the other contact and the vapor shield.

DESCRIPTION OF THE PREFERRED EMBODIMENTS

The preferred embodiments of this invention will be described below with reference to the attached drawings.

Tests for examining the contributions of materials for the contact and the metal end plate to the interruption performance of vacuum interrupter were carried out in order to discover preferred combinations of the materials for the contact and the metal end plate. The vacuum interrupter of FIG. 2 with contacts made of various materials was used in these tests.

Figure 2:
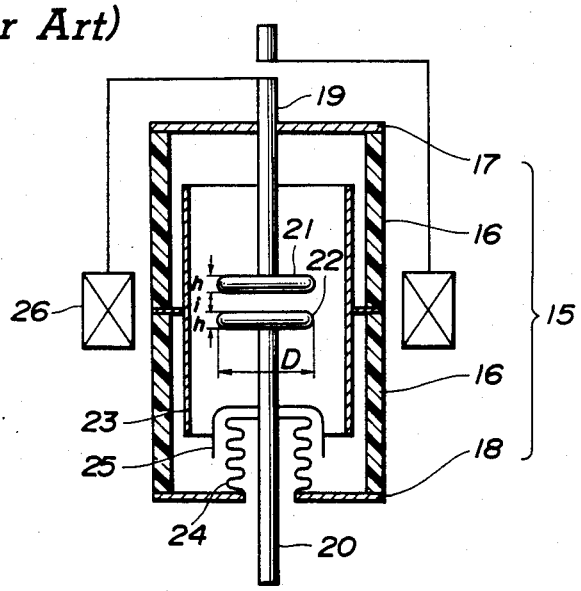
FIG. 2 (Prior Art)
FIG. 2 is a diagrammatical longitudinal section through another prior-art vacuum interrupter with an axial magnetic field generating coil surrounding a cylindrical portion of a vacuum envelope.

The vacuum interrupter of FIG. 2 comprises a vacuum envelope 15. The major part of the vacuum envelope 15 consists of a pair of insulating cylinders 16 made of alumina ceramics and joined end-to-end, and two metal end plates 17 and 18, each sealing one end face of the insulating cylinders 16. A stationary lead rod 19 extends to the center of the vacuum envelope 15 through the end plate 17 and a movable lead rod 20 similarly extends to the center of the vacuum envelope 15 through the other end plate 18. The lead rods 19 and 20 end at a disc-shaped stationary contact 21 and a disc-shaped movable contact 22 respectively. A cylindrical intermediate-potential shield 23 made of metal surrounds the contacts 21 and 22 and is supported by the insulating cylinders 16. A bellows 24 sealingly connects the movable lead rod 20 to the end plate 18. A bellows shield 25 is mounted on the movable lead rod 20 in front of the inner end of the bellows 24. An axial magnetic field generating coil 26 surrounds the insulating cylinders 16 at their juncture. The axial magnetic field generating coil 26 is connected in series to the stationary lead rod 19. The diameter D of the contacts 21 and 22 is variable in FIG. 3 and 50 mm in FIG. 4. The thickness h of the contacts 21 and 22 is 5 mm. The arcing gap i between the contacts 21 and 22 is 12 mm in FIG. 3 and variable in FIG. 4.

Figure 3:
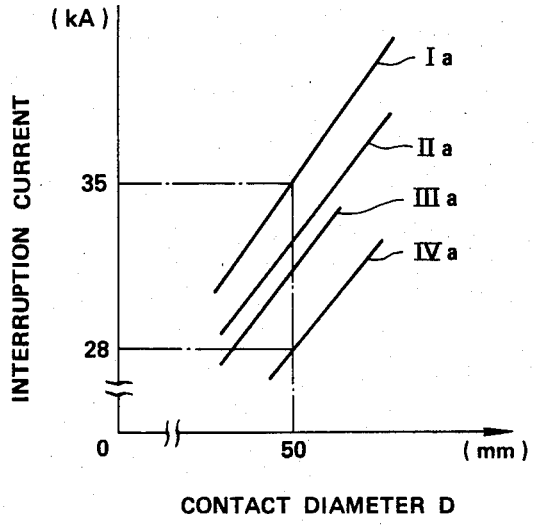
FIG. 3 is a graph of the relationship between diameters of contacts made of various materials and interruption current in the vacuum interrupter of FIG. 2.

FIG. 3 shows the relationship between contact diameter and interruption current of the tested vacuum interrupter of FIG. 2 for different materials for the contacts 21 and 22. In FIG. 3, the straight line Ia represents the case in which the contacts 21 and 22 were made of the Cu-25Mo-7Cr composite material, the straight line IIa represents a case in which the contacts 21 and 22 were made of SUS 304L, the straight line IIIa represents a case in which the contacts 21 and 22 were made of an Fe-Ni-Co alloy, the straight line IVa represents the case in which the contacts 21 and 22 were made of Cu. SUS 304L, a Fe-Ni-Co alloy and Cu are commonly used materials for metal end plate of vacuum envelopes. The voltage of the test current was 12 kV (r.m.s.). The arcing gap between the contacts 21 and 22 was 12 mm.

Figure 4:
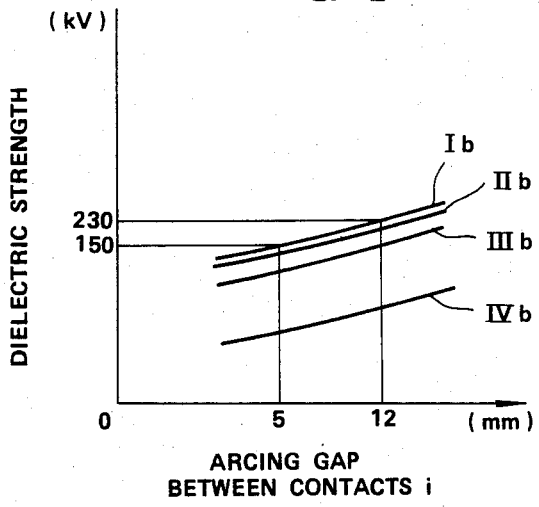
FIG. 4 is a graph of the relationship between the arcing gap between the contacts made of various materials and the impulse dielectric strength of the vacuum interrupter of FIG. 2.

FIG. 4 shows the relationship between the arcing gap between the contacts and the dielectric strength of the tested vacuum interrupter of FIG. 2 after the vacuum interrupter interrupts a 25 kA current at 12 kV (r.m.s.) 10 times. The same materials were used in the contacts 21 and 22 as in FIG. 3. In FIG. 4, the straight line Ib represents the case in which the contacts 21 and 22 were made of the same material as in the case of line Ia in FIG. 3, and the straight lines IIb, IIIb and IVb each represent the cases in which the contacts 21 and 22 are made of the same materials as in the cases of lines IIa, IIIa and IVa in FIG. 3.

As apparent from FIGS. 3 and 4, the material of Cu-25Mo-7Cr contributes more to the current interruption capability and the dielectric strength of the vacuum interrupter than austenitic stainless steel (SUS 304L), Fe-Ni-Co alloy and Cu. In addition, these tests revealed that austenitic stainless steel was low in the dielectric strength of the vacuum interrupter right after circuit interruption even though austenitic stainless steel (SUS 304L) was generally thought to be high in the dielectric strength of the vacuum interrupter.

Figure 1:
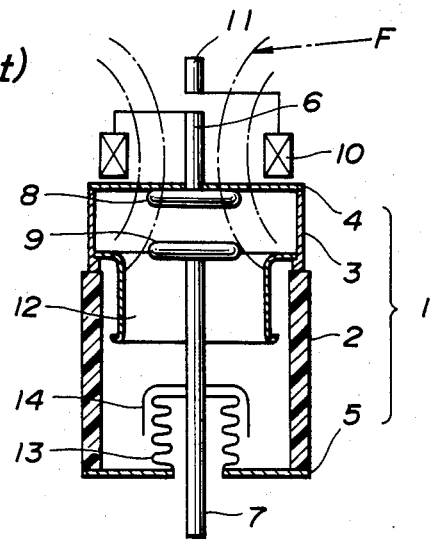
FIG. 1 (Prior Art)
FIG. 1 is a diagrammatical longitudinal section through a prior-art vacuum interrupter with an axial magnetic field generating coil disposed behind one contact.

The vacuum interrupter of FIG. 1 was checked from the results of the tests carried out on the vacuum interrupter of FIG. 2. It was found that since the contacts 8 and 9 were made of a Cu-25Mo-7Cr composite material and the end plates 4 was made of SUS 304L, a material (e.g., austenitic stainless steel) which contributes less to the current interruption capability and the dielectric strength of the vacuum interrupter than the Cu-25Mo-7Cr of the contacts 8 and 9 is provided right behind the stationary contact 8. In addition, it was found that since the stationary contact 8 and the end plate 4 are coaxially aligned and the surface area of the end plate 4 is greater than that of the stationary contact 8, the properties of the end plate 4 can affect the current interruption capability and the dielectric strength of the vacuum interrupter in that the foot of the electrical arc generated between the contacts 8 and 9 could transfer from the periphery of the contact 8 to the end plate 4.

Figure 5:
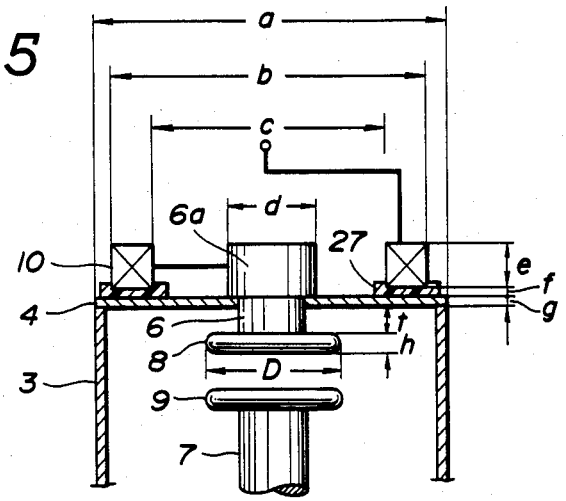
FIG. 5 is a diagrammatical longitudinal section through a major part of a vacuum interrupter according to a first embodiment of this invention.

Finally, the present inventors tested how much clearance between a stationary contact and a metal stationary-side end plate mounting the contact was needed to prevent electrical arc in the arcing gap between the contacts from transferring from the contact to the end plate and thus reducing the effect of the axial magnetic field of the coil 10. In this test, the interruption performance of a vacuum interrupter according to a first embodiment of this invention was inspected as the clearance t between the stationary contact 8 and the stationary-side end plate 4 was varied. A major part of the first embodiment vacuum interrupter is shown in FIG. 5. The other part of the first embodiment vacuum interrupter is the same as in the example of FIG. 1. In FIG. 5, the axial magnetic field generating coil 10 is held by an annular holder 27 made of an insulating material and fixed to the outer surface of the end plate 4. Dimensions of parts of a tested vacuum interrupter according to the first embodiment of this invention are as follows:

TABLE 1

| Parts | Dimension mm |
|---|---|
| Outer diameter a of the metal cylinder 3 | 110 |
| Outer diameter b of the coil 10 | 100 |
| Inner diameter c of the coil 10 | 80 |
| Diameter d of an enlarged portion 6a of the stationary lead rod 6 at the center of the coil 10 | 30 |
| Thickness e of the coil 10 | 15 |
| Distance f between the outer surface of the end plate 4 and the opposing surface of the coil 10 | 2 |
| Thickness g of the end plate 4 | 3 |
| Thjckness h of the stationary contact 8 | 5 |
| Diameter D of the stationary contact 8 | 50 or 60 |
| Arcing gap between the contacts 8 and 9 | 12 |
| Inner diameter of the metal cylinder 3 | 105 |

In Table 1, the inner diameter of the metal cylinder 3 is (D+55) mm in the case in which the diameter D of the stationary contact 8 is 50 mm or (D+45) mm in the case in which the diameter D of the stationary contact 8 is 60 mm. The diameter of the movable contact 9 is equal to the diameter D of the stationary contact 8. The inner diameter c of the coil 10 is no less than the diameter D of the stationary contact 8 (i.e. $c \geqq D$) so that the axial magnetic field produced by the coil 10 can act on both of the stationary contact 8 and the movable contact 9.

The tested vacuum interrupter constantly interrupted a current of 30 kA at 12 kV r.m.s. in the case in which the diameter D of the stationary contact 8 was 50 mm. It also constantly interrupted a current of 35 kA at 12 kV r.m.s. in the case in which the diameter D of the stationary contact 8 was 60 mm. These levels of interruption performance are shown to be 100% in FIG. 6, discussed later.

Figure 6:
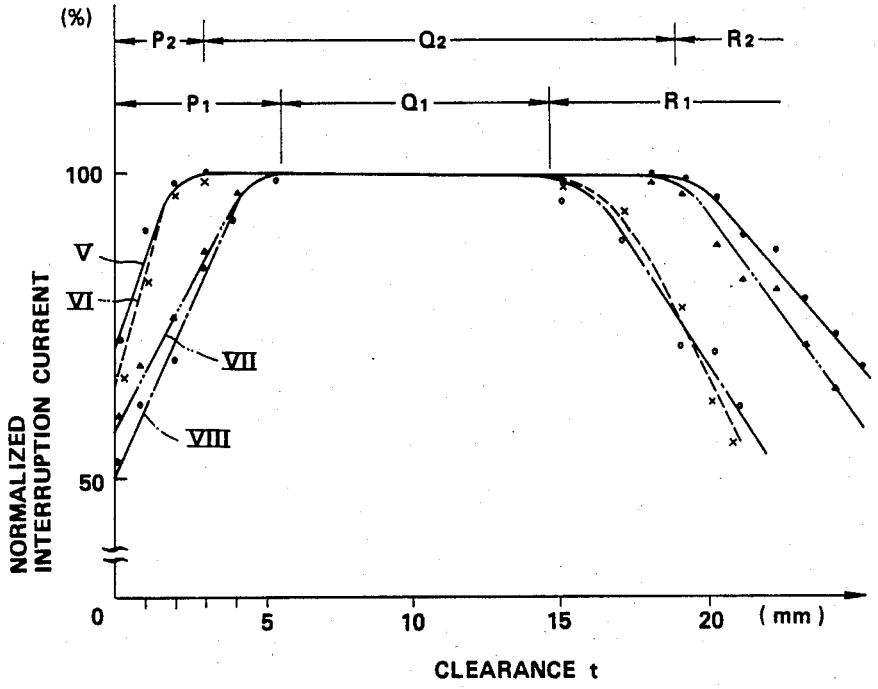
FIG. 6 is a graph of the relationship between the clearance between the stationary contact and the stationary-side metal end plate, and the normalized interruption current in the first embodiment vacuum interrupter.

FIG. 6 shows the normalized values of the amperage of the interruption current for various clearances t between the stationary contact 8 and the statioary-side end plate 4. The normalized values are expressed in terms of the percentages of the interruption current of a vacuum interrupter of FIG. 5 in which the contacts 8 and 9 are made of the Cu-25Mo-7Cr composite material and the end plate 4 is made of SUS 304L. The curve V plotted in solid dots represents the case in which the diameter D of the stationary contact 8 is 60 mm and the end plate 4 is made of SUS 304L. The curve VI plotted in X's represents the case in which the diameter D of the stationary contact 8 is 50 mm and the end plate 4 is made of SUS 304L. The curve VII plotted in triangles represents the case in which the diameter D of the stationary contact 8 is 60 mm and the end plate 4 is made of Cu. The curve VIII plotted in hollow dots represents a case in which the diameter D of the stationary contact 8 is 50 mm and the end plate 4 is made of Cu. In all cases, the contacts 8 and 9 are made of the Cu-25Mo-7Cr composite material.

In the case of the curve VIII, in the range P1 ($t \leqq$ about 5 mm), the current interruption capability of the vacuum interrupter is reduced since the reduced clearance t between the stationary contact 8 and the stationary-side end plate 4 causes the foot of the electrical arc on the stationary contact 8 to transfer to the end plate 4. In the range Q1 (about 5 mm $\leqq t \leqq$ about 15 mm), the vacuum interrupter operates at full current-interruption capability. In the range R1 ($t \geqq$ about 15 mm), the current interruption capability of the vacuum interrupter is reduced since the increased clearance t between the stationary contact 8 and the stationary-side end plate 4 reduces the effect of the axial magnetic field of the coil 10.

In the case of the curve V, the range P2 ($t \leqq$ about 2 mm) corresponds to the range P1, the range Q2 (about 2 mm $\leqq t \leqq$ about 20 mm) corresponds to the range Q1, and the range R2 ($t \geqq$ about 20 mm) corresponds to the range R1.

As apparent from the comparison of the group of curves V and VI and the group of curves VII and VIII, the magnitude of the current interruption capability depends predominantly on the properties of the material of the stationary-side end plate 4 in the range where the clearance t is relatively small and on the other hand, depends less on the properties of the material of the stationary-side end plate 4 at larger clearances t. At larger clearances t, the intensity of the axial magnetic field of the coil 10 is believed to dominate the current interruption capability.

As apparent from the comparison of the group of curves V and VII and the group of curves VI and VIII, the vacuum interrupter can operate at its full current interruption capability even if the clearance t is slightly increased since the increased diameter D of the stationary contact 8 increases the scope of the axial magnetic field of the coil 10.

The values of the ranges Q1 and Q2 in which the first embodiment vacuum interrupter operates at full current-interruption capability are shown in a following table 2.

TABLE 2

| Material of end plate 4 | Contact diameter D 50 mm | 60 mm |
|---|---|---|
| SUS 304L | t = 2 to 15 mm | t = 2 to 20 mm |
| Cu | t = 5 to 15 mm | t = 5 to 20 mm |

As apparent from FIG. 6 and Table 2, the upper limit of the clearance t depends on the diameter D of the stationary contact 8 since the single coil 10 is used to generate the axial magnetic field. The upper limit of the clearance t is 0.3D in the case in which the diameter D of the stationary contact 8 is 50 mm, and similarly about 0.3D in the case in which the diameter D of the stationary contact 8 is 60 mm.

Thus, if 2 mm$\leqq$t$\leqq$0.3D in the case in which the end disc 4 is made of SUS 304L, the first embodiment vacuum interrupter exhibits its full current-interruption capability. On the other hand, the first embodiment vacuum interrupter exhibits its full current-interruption capability if 5 mm$\leqq$t$\leqq$0.3D in the case in which the end plate 4 is made of Cu.

The interruption performance test was carried out on samples in which the diameter D of the stationary contact 8 was 30 to 80 mm and the inner diameter of the metal cylinder 3 was (D+25) mm to (D+70) mm. The results of these tests were similar to those in the cases in which the diameter D of the stationary contact 8 was 50 or 60 mm and the inner diameter of the metal cylinder 3 was 105 mm.

Figure 7:
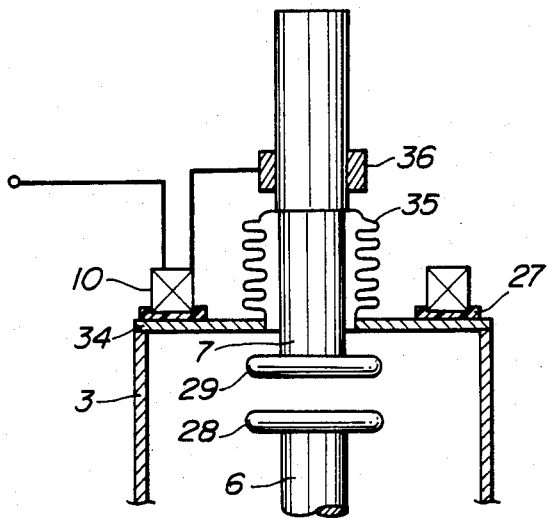
FIG. 7 is a diagrammatical longitudinal section through a major part of a vacuum interrupter according to a second embodiment of this invention.
Figure 8:
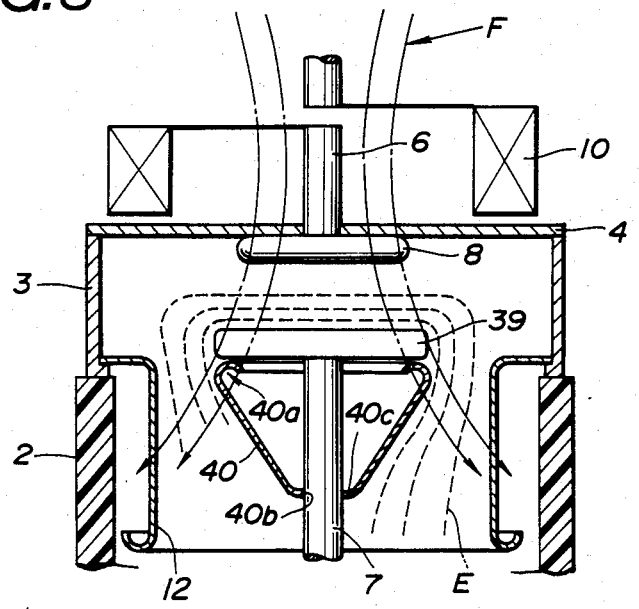
FIG. 8 is a diagram of the effects of a moderating shield and a movable contact with an enlarged diameter, both according to this invention.

FIG. 7 shows a major part of a vacuum interrupter according to a second embodiment of this invention. The same reference numerals are applied to parts of the second embodiment vacuum interrupter matching parts of the first embodiment vacuum interrupter. The other part of the second embodiment vacuum interrupter is substantially the same as in the example of FIG. 1. Different points from the example of FIG. 1 are described later. A movable contact 29 constitutes a coil-side contact near an axial magnetic field generating coil 10. While a stationary contact 28 constitutes a contact remote from the coil 10. The movable contact 29 and the stationary contact 28 are made of the same Cu-25Mo-7Cr composite material as the stationary contact 8 in the first embodiment of this invention. The diameter of the stationary contact 28 is equal to that of the movable contact 29. A movable-side end plate 34 is made of austenitic stainless steel (e.g., SUS 304L) while a stationary-side end plate, not shown, is made of Fe-Ni-Co alloy (e.g., Koval). A movable lead rod 7 extends through the movable-side end plate 34. The cylindrical surface of the movable lead rod 7 is in contact slidably with a slide contact 36 which is electrically connected to one terminal of the coil 10. A bellows 35, which is disposed outside a metal cylinder 3, sealingly connects the movable lead rod 7 to the movable-side end plate 34. A stationary lead rod 6 having a stationary contact 38 extends through the stationary-side end plate without a bellows 13 of FIG. 1.

In the same manner as in the first embodiment vacuum interrupter, the present inventors tested how much clearance t between a movable contact and a movable-side metal end plate mounting the movable contact was needed to prevent the electrical arc in the arcing gap between the contacts from transferring from the movable contact to the movable-side end plate. The dimensions of parts of the tested vacuum interrupter according to the second embodiment of this invention are equal to those of the tested vacuum interrupter according to the first embodiment of this invention. The clearance t is determined in a state in which the arcing gap between the contacts 28 and 29 is at full as shown in FIG. 7. Results of this test were the same as those in the first embodiment vacuum interrupter.

Figure 9:
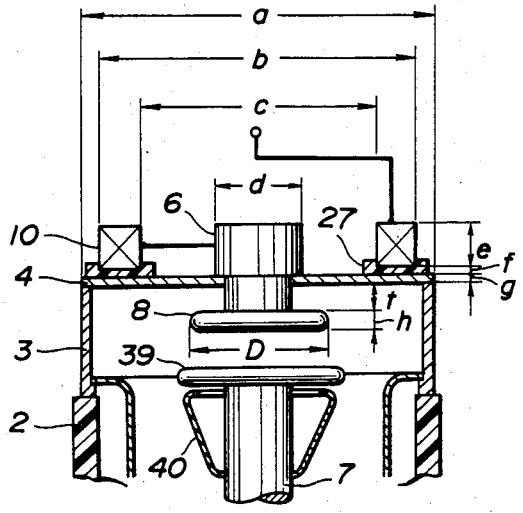
FIG. 9 is a diagrammatical longitudinal section through a major part of a vacuum interrupter according to a third embodiment of this invention.

FIG. 9 shows a major part of a vacuum interrupter according to a third embodiment of this invention. The other part of the third embodiment vacuum interrupter is the same as in the example of FIG. 1. The same reference numerals are applied to parts of the third embodiment vacuum interrupter matching parts of the first embodiment vacuum interrupter. A movable contact 39 is made of the same Cu-25Mo-7Cr composite material as the movable contact 9 in the first embodiment of this invention.

In the same manner as in the first embodiment vacuum interrupter, the present inventors tested how much clearance between a stationary contact and a statiionary-side metal end plate mounting the stationary contact was needed to prevent the electrical arc in the arcing gap between the contacts from transferring from the stationary contact to the stationary-side end plate and thus reducing the effect of the axial magnetic field of the coil 10. The dimensions of parts of the tested vacuum interrupter according to the third embodiment of this invention are equal to those of the tested vacuum interrupter according to the first embodiment of this invention except for the diameter of the movable contact 39, which is 1.1×D (mm).

The tested vacuum interrupter constantly interrupted a current of 34 kA at 12 kV r.m.s. in the case in which the diameter D of the stationary contact 8 was 50 mm and the diameter of the movable contact 39 was 60 mm. It also constantly interrupted a current of 39 kA at 12 kV r.m.s. in the case in which the diameter D of the stationary contact 8 was 60 mm and the diameter of the movable contact 39 was 66 mm.

Figure 10:
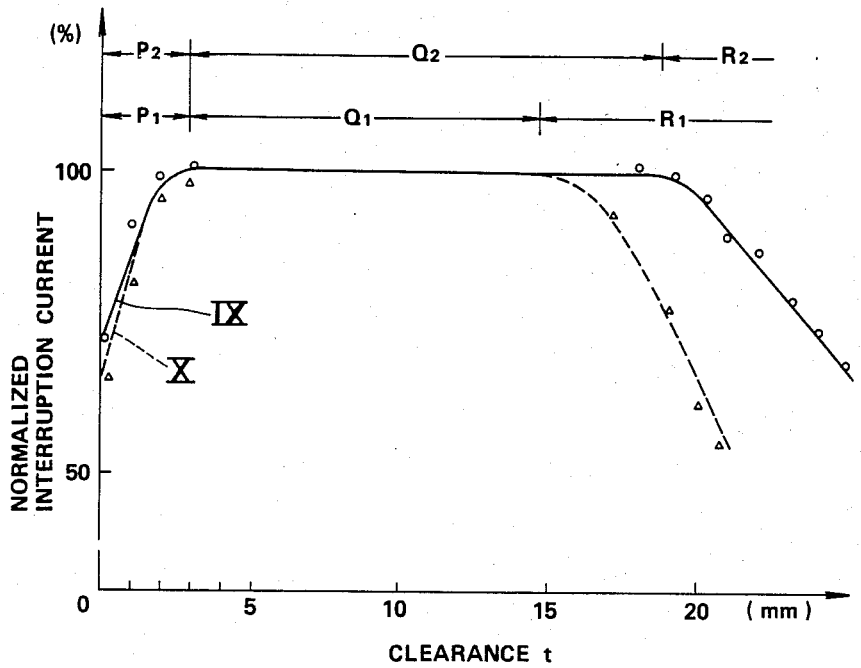
FIG. 10 is a graph similar to FIG. 6 for the second embodiment.

FIG. 10 is similar to FIG. 6, showing normalized values of the amperage of interruption current for various clearances t between the stationary contact 8 and the stationary-side end plate 4. The curve IX plotted in hollow dots represents the case in which the diameter D of the stationary contact 8 is 60 mm and the end plate 4 is made of SUS 304L. The curve X plotted in triangles represents the case in which the diameter D of the stationary contact 8 is 50 mm and the end plate 4 is made of SUS 304L.

The values of the ranges Q1 and Q2 in which the third embodiment vacuum interrupter operates at its full current-interruption capability are shown in the following Table 3:

TABLE 3

| Material of end plate 4 | Diameter D of stationary contact 8 50 mm | 60 mm |
|---|---|---|
| SUS 304L | t = 2 to 15 mm | t = 2 to 20 mm |

As apparent from FIG. 10 and Table 3, if 2 mm$\leqq$t<0.3D, the third embodiment vacuum interrupter exhibits at its full current-interruption capability at both values of the diameter D of the stationary contact 8.

The interruption performance test was carried out on examples in which the diameter D of the stationary contact 8 was 30 to 80 mm and the inner diameter of the metal cylinder 3 was (D+25) mm to (D+70) mm. The results of this test are similar to those in the cases in which the diameter D of the stationary contact 8 was 50 or 60 mm and the inner diameter of the metal cylinder 3 was 105 mm.

In the third embodiment of this invention, the end plate 4 may be alternatively made of Cu or an Fe-Ni-Co alloy, so that advantages similar to those in the case where the end plate 4 is made of SUS 304L can be obtained.

Figure 11A:
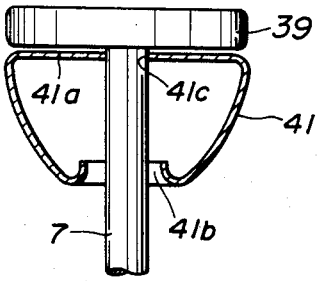
FIG. 11A is a longitudinal section through a modification to the moderating shield of FIG. 9.

FIG. 11A illustrates a moderating shield 41 according to a first modification to the moderating shield 40. The moderating shield 41 has an essentially conical shape. The disc-shaped base 41*a* of the moderating shield 41 opposes the back surface of the movable contact 39 and has a central aperture 41*c* through which the movable lead rod 7 passes. The apertured apex of the moderating shield 41 has an annular curl 41*b*. The moderating shield 41 is mounted on the movable lead rod 7 at the aperture 41*c*. The outer side surface of the moderating shield 41 is convex.

Figure 11B:
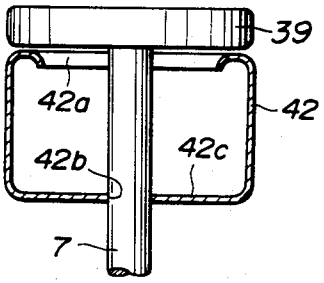
FIG. 11B is a longitudinal section through a second modification to the moderating shield of FIG. 9.

FIG. 11B illustrates a moderating shield 42 according to a second modification to the moderating shield 40. The moderating shield 42 is generally a cylindrical shell with a floor. The open end of the moderating shield 42 opposes the back surface of the movable contact 39 and has an annular curl 42*a* curving into the interior of the moderating shield 42. The outer diameter of the annular curl 42*a* is substantially equal to that of the movable contact 39. A sealed end of the moderating shield 42 has a disc-shaped floor 42*c* with a central aperture 42*b* through which the movable lead rod 7 passes. The moderating shield 42 is mounted on the movable lead rod 7 at the aperture 42*b*.

In the first, second and third embodiments of this invention, the contacts 8, 9 and 39 are made of a powder-metallurgically produced composite material with the composition Cu-Mo-Cr. Alternatively, W and/or Nb may be used in place of Mo, and at least of Fe, Ni and Co may be used in place of Cr, while producing effects similar as to those of the first, second and third embodiments of this invention described above.

The proportions of Cu, the refractory metal element and the iron-group metal element are determined in view of requirements for the contact material. Preferably, the proportion of Cu is 20 to 80 weight %, the refractory metal element is 5 to 45 weight % and the iron-group metal element is 5 to 45 weight %.

Copper below 20 weight % significantly reduces the electrical conductivity of the contacts and significantly increases the electrical contact resistance of the contacts. On the other hand, copper above 80 weight % significantly increases the current chopping level and significantly reduces the anti-welding capability and the dielectric strength of the contacts.

A refractory metal content below 5 weight % significantly reduces the dielectric strength of the contacts. On the other hand, a refractory metal content above 45 weight % significantly reduces the mechanical strength of the contact and significantly increases the current chopping level.

An iron-group metal content below 5 weight % significantly reduces the dielectric strength of the contacts. On the hand, an iron-group metal content above 45 weight % significantly reduces the electrical conductivity of the contacts.

What is claimed is:

1. A vacuum interrupter comprising a vacuum envelope including an electrically insulating cylinder; a pair of metallic stationary- and movable-side end plates constituting part of the vacuum envelope and hermetically sealed to opposite open ends of the insulating cylinder, one of the end plates being a coil-side end plate; a pair of relatively movable disc-shaped contacts supported within the vacuum envelope, a movable contact being movable by a bellows from a closed position in conductive engagement with a stationary contact, and at an open position the movable contact separated from the stationary contact with an arcing gap therebetween across which an arc forms during circuit interruption, one of the contacts being a coil-side contact; a pair of electrical lead members each supporting and electrically connected to a corresponding contact; and a coil disposed outside the vacuum envelope and near the coil-side end plate for generating an axial magnetic field parallel to the path of the arc in the arcing gap, characterized in that said coil-side contact is made of a material superior in interruption performance to said coil-side end plate, and that the coil-side contact is mounted with a clearance to the coil-side end plate, the clearance being at least 2 mm and at most 30% of the diameter of the coil-side contact.

2. A vacuum interrupter of claim 1, characterized in that the coil-side end plate is made of austenitic stainless steel.

3. A vacuum interrupter of claim 1, characterized in that the coil-side end plate is made of Cu and that the clearance is at least 5 mm.

4. A vacuum interrupter of claim 1, characterized in that the coil-side contact is made of a composite material consisting essentially of Cu, at least one of Mo, W and Nb, and at least one of Cr, Fe, Ni and Co.

5. A vacuum interrupter of claim 1, characterized in that the coil-side contact is made of a composite material consisting essentially of 20 to 80 weight % of Cu, 5 to 45 weight % of Mo, and 5 to 45 weight % of Cr.

6. A vacuum interrupter of claim 1, characterized in that the coil-side contact is a stationary contact.

7. A vacuum interrupter of claim 1, characterized in that the coil-side contact is a movable contact and in that the bellows is disposed so that inner surfaces of the bellows is subjected to a vacuum inside the vacuum envelope.

8. A vacuum interrupter comprising a vacuum envelope including an electrically insulating cylinder; a pair of metallic stationary- and movable-side end plates constituting part of the vacuum envelope and hermetically sealed to opposite open ends of the insulating cylinder, one of the end plates being a coil-side end plate; a pair of relatively movable disc-shaped contacts supported within the vacuum envelope, a movable contact being movable by a bellows from a closed position in conductive engagement with a stationary contact, and at an open position the movable contact being separated from the stationary contact with an arcing gap therebetween across which an arc forms during circuit interruption, one of the contacts being a coil-side contact; a pair of electrical lead members each supporting and electrically connected to a corresponding contact; a coil disposed outside the vacuum envelope and near the coil-side end plate for generating an axial magnetic field parallel to the path of the arc in the arcing gap; and a vapor shield disposed within the insulating cylinder, the vapor shield being at a potential different from a potential of the other contact, characterized in that said coil-side contact is made of a material superior in interruption performance to said coil-side end plate and that the coil-side contact is mounted with a clearance to the coil-side end plate, the clearance being at least 2 mm and at most 30% of the diameter of the coil-side contact and that the diameter of the other contact is greater than that of the coil-side contact and that the vacuum interrupter has a shield moderating a concentration of electric field generated at the outer portion of the other contact in a gap between the other contact and the vapor shield.

9. A vacuum interrupter of claim 8, characterized in that the coil-side end plate is made of austenitic stainless steel.

10. A vacuum interrupter of claim 8, characterized in that the coil-side end plate is made of Cu and that the clearance is at least 5 mm.

11. A vacuum interrupter of claim 8, characterized in that the coil-side contact is made of a composite material consisting essentially of Cu, at least one of Mo, W and Nb, and at least one of Cr, Fe, Ni and Co.

12. A vacuum interrupter of claim 8, characterized in that the coil-side contact is made of a composite material consisting essentially of 20 to 80 weight % of Cu, 5 to 45 weight % of Mo, and 5 to 45 weight % of Cr.

13. A vacuum interrupter of claim 8, characterized in that the other contact is a stationary contact.

14. A vacuum interrupter of claim 8, characterized in that the other contact is a movable contact.

15. A vacuum interrupter of claim 8, characterized in that the moderating shield is conical, a larger end of the moderating shield opposing the back surface of the other contact.

16. A vacuum interrupter of claim 8, characterized in that the moderating shield is cylindrical, one end of the moderating shield opposing the back surface of the other contact.

* * * * *